US009246243B2

(12) United States Patent
Schuetz et al.

(10) Patent No.: US 9,246,243 B2
(45) Date of Patent: Jan. 26, 2016

(54) CONTACTING UNIT

(71) Applicant: Harting Electronics GmbH, Espelkamp (DE)

(72) Inventors: Christian Schuetz, Hille (DE); Guenter Pape, Enger (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/417,602

(22) PCT Filed: Aug. 14, 2013

(86) PCT No.: PCT/DE2013/100292

§ 371 (c)(1),
(2) Date: Jan. 27, 2015

(87) PCT Pub. No.: WO2014/026677

PCT Pub. Date: Feb. 20, 2014

(65) Prior Publication Data

US 2015/0214640 A1 Jul. 30, 2015

(30) Foreign Application Priority Data

Aug. 16, 2012 (DE) ..... 10 2012 107 494

(51) Int. Cl.

| | |
|---|---|
| ***H01R 4/48*** | (2006.01) |
| ***H01R 4/52*** | (2006.01) |
| ***H01R 4/50*** | (2006.01) |

(52) U.S. Cl.
CPC ..... *H01R 4/52* (2013.01); *H01R 4/489* (2013.01); *H01R 4/4818* (2013.01); *H01R 4/5083* (2013.01)

(58) Field of Classification Search
USPC ..... 439/863, 835, 834, 441
See application file for complete search history.

(56) References Cited

U.S. PATENT DOCUMENTS

| | | | | |
|---|---|---|---|---|
| 4,973,271 | A | 11/1990 | Ishizuka et al. | |
| 7,249,963 | B2 * | 7/2007 | Ramm | H01R 13/193 439/437 |
| 2002/0177341 | A1 | 11/2002 | Stein, Sr. et al. | |

FOREIGN PATENT DOCUMENTS

| | | |
|---|---|---|
| DE | 202009002239 | 7/2010 |
| EP | 2325947 | 5/2011 |

* cited by examiner

*Primary Examiner* — Tho D Ta
(74) *Attorney, Agent, or Firm* — Jacobson Holman, PLLC.

(57) ABSTRACT

The present invention relates to a contacting unit (t) for electrical conductors or pin contacts (8). Contacting units (1) of this kind are used for reversibly contacting said conductors or pin contacts (8) in an electrical and mechanical manner. In the present invention, the spring force that acts on a conductor or pin contact (8) to be connected can be variably adjusted. To this end, the free, spring-loaded length of a spring contact member (11) is varied by means of a sliding element (20). As a result of the variation of the spring-loaded length of the spring contact member (11), the spring force is increased in the case of a shortening and is correspondingly reduced in the case of an extension.

8 Claims, 4 Drawing Sheets

CONTACTING UNIT

The invention relates to a contacting unit for electrical conductors and pin contacts according to the preamble of independent claim 1.

Contacting units of this kind are needed to reversibly contact electrical conductors and to enable the onward transmission of an electrical signal or of electrical energy. Thus, for example, a contacting unit of this kind can, if attached to a printed circuit board, electrically connect an electrical conductor to this printed circuit board.

Contacting units of this kind are also provided in plug-in connectors for fixing electrical conductors to a plug-in connector and to contact them with the latter.

Apart from electrical conductors, also contacting of contacts—so-called in contacts—using a contacting unit of this kind is provided. To this end, one or more contacting units are provided in a plug-in connector housing, in order to contact pin contacts inserted there from a corresponding mating plug-in connector.

PRIOR ART

From the prior art, a multiplicity of contacting units is known. For the most part, these units substantially consist of a spring member that mechanically clamps a conductor to be inserted or a contact to be inserted.

The electrical contacting of the conductor or contact is realised via the spring member itself or via a metallic region in the unit, against which the spring member presses the conductor or contact.

The clamping force generated, with which the electrical conductor or contact is clamped and thus contacted, is as a rule defined by the geometry and the material properties of the spring member. Depending on the material strength of the spring member and how the latter is shaped, an inserted electrical conductor or contact will be clamped with different strengths.

What is of disadvantage in respect of the solutions known from the prior art is that each of the contacting units only has one defined contacting force. This is disadvantageous above all if a multiplicity of contacting units, which are combined to form a plug-in connector, are to be contacted at the same time. Moreover, the contacting force changes as a function of the cross section of a contacted electrical conductor.

The term contacting force of the contacting unit is to be understood to mean in each case both the plug-in force, i.e. the force needed for inserting an electrical conductor or pin contact, and the holding force, i.e. the force that is needed to pull a contacted electrical conductor or pin contact out of the contacting unit.

Therefore, what is also to be regarded as disadvantageous in the prior art is that individual conductors that are contacted in a corresponding device can be released from the contacted condition only with a large amount of force.

OBJECT OF THE INVENTION

It is the object of the invention to provide a contacting unit that allows the contacting force to be adjusted. It is to be made possible to reduce the plug-in forces for the contacting of an electrical conductor or contact and to increase retrospectively, after the contacting process, the holding forces in order to ensure a secure electrical contact. Further, it is to be made possible to variably adjust the contacting forces for different cross sections of electrical conductors. Moreover, it is desirable to reduce the holding force for releasing the contact.

The object is achieved by means of the characterising features of independent claim 1.

Advantageous embodiments of the invention are indicated in the dependent claims.

The present invention relates to a contacting unit for electrical conductors and pin contacts. The contacting unit comprises a contact member formed as a spring contact, which contact member is disposed in a contact chamber.

The contact chamber is preferably provided in an insulation body. The insulation body may here include just one single contact chamber with a spring contact member or a multiplicity of provided contact chambers and spring contact members disposed therein, which form a so-called terminal block or a plug-in connector.

Apart from said contact chamber, the insulation body also includes an insertion opening designed to receive an electrical conductor or contact to be contacted. The latter can be inserted into the contact chamber through the insertion opening and can be contacted with the spring contact member present there.

The spring contact member of the contacting unit is formed from a fixed end and a free end. The fixed end is provided for fixing the spring contact member in the contact chamber. The free end of the spring contact member is used for fixing and contacting an electrical conductor or contact.

The spring contact member, which is preferably made up from two legs, is clamped between two oppositely disposed lateral surfaces of the contact chamber. In the course of this, an inserted conductor or contact is clamped between one of the legs—the contact leg—and a lateral surface of the contact chamber.

The second leg of the spring contact member—the spring force leg—rests against the opposite lateral surface of the contact chamber. As a result, the two legs of the spring contact member generate the required contacting force in order to contact an inserted electrical conductor or contact.

According to the invention, a sliding element is provided between the spring force leg and the lateral surface, against which the spring force leg rests. The sliding element is here used for adjusting the spring force, with which the free end of the spring contact member acts in the contact chamber.

According to the invention, the spring force leg does not directly rest against the lateral surface of the contact chamber, but against said sliding element. By displacing the sliding element along the spring force leg, the length of the free end of the spring contact member and thus the contacting force of the contacting unit may be varied.

In the case of a shortened free end of the spring contact member, the spring force, with which the free end is clamped in the contact chamber, is greater than the spring force of the free end, if the length thereof is not shortened.

Further embodiments of the invention can be seen from the dependent claims.

EMBODIMENT EXAMPLE

An embodiment example of the invention is shown in the drawings and will be explained in more detail below, wherein.

Figure 1:
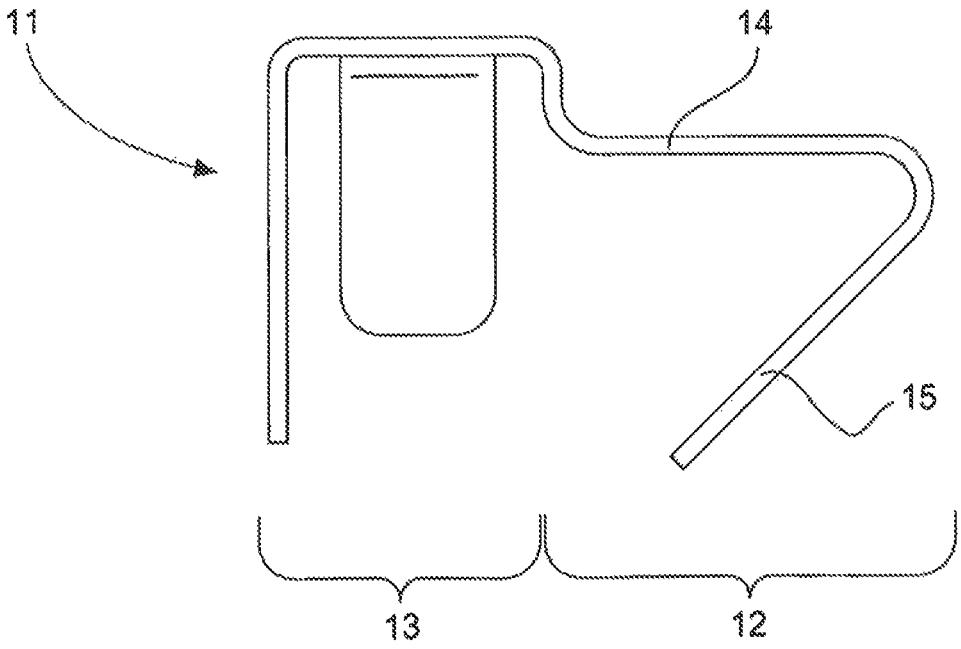
FIG. 1 shows a spring contact member.

FIG. 1 shows a spring contact member 11 for use in a contacting unit 1 according to the invention. The spring contact member 11 substantially includes two regions: a fixed end 13 and a free end 12.

The fixed end 13 of the spring contact member 11 is used for fastening and fixing the spring contact member 11 in a contact chamber 3 as well as for electrically contacting the spring contact member 11 with further components, printed circuit boards or the like.

The free and 12 of the spring contact member 11 is provided as a spring-loaded contact region. To this end, the free end 12 is expediently formed from two legs: a contact leg 15 for contacting an electrical conductor or pin contact 8, and a spring force leg 14 that is used for adjusting the spring force.

In this embodiment example, the two legs 14, 15 are arranged at an angle of approx. 45° relative to each other, forming a V shape. Other angles for arranging the legs relative to each other are of course also conceivable, so that this angle is not limited to 45°. Expediently however, the angle should be in a range between 0° and 180°.

Figure 2:
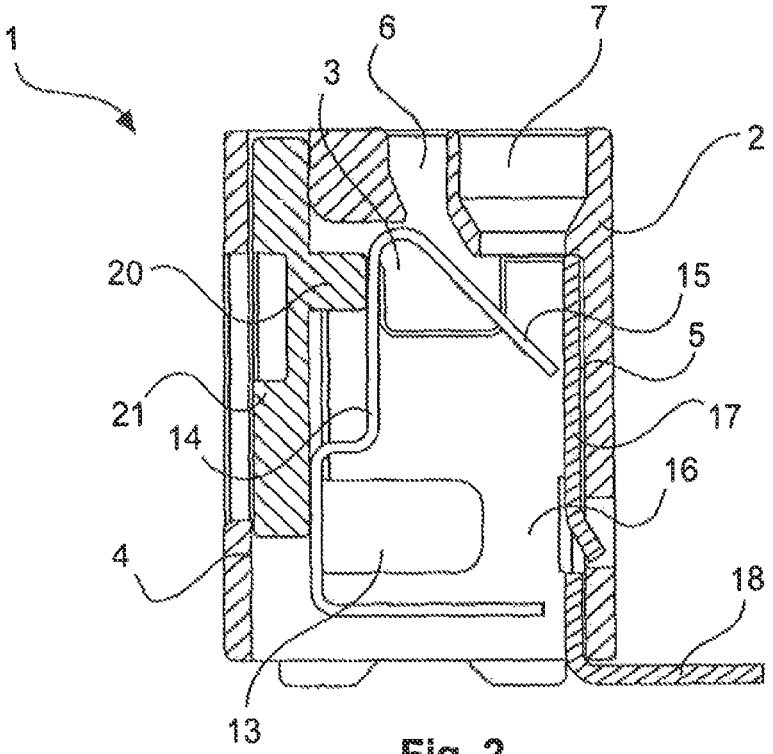
FIG. 2 shows a cross section through a contacting unit.

FIG. 2 shows a cross section through a contacting unit 1 according to the invention. What can be seen is an insulation body 2 that forms the housing of the contacting unit 1. Within the insulation body 2, a contact chamber 3 is provided that receives a spring contact member 11, a contact receptacle 16 and a sliding element 20.

Apart from the contact chamber 3, the insulation body 2 also has two openings 6 and 7. The opening 7 is provided as an insertion opening for inserting an electrical conductor or pin contact 8 to be contacted. The opening 6 is used as a release opening. An elongated item (e.g. a screwdriver) can be inserted into this opening in order to release the contact of a connected electrical conductor or pin contact 8.

In the bottom area shown, the insulation body 2 has a further, wide opening into the contact chamber 3. This is merely used for assembling the individual members in the insulation body 2 and has no inventive purpose.

A person skilled in that art will know a large variety of possibilities from the prior art for latching the spring contact member 11 and the contact receptacle 16 together in the insulation body 2. In this embodiment example, the contact receptacle 16 is held in a recess in the insulation body 2 by means of a locking lug. The latching will not be discussed here in any more detail.

The spring contact member 11 received in the contact chamber 2 is held in the contact chamber 2 in the area of the fixed end 13 that is shown at the bottom. In this embodiment example, the spring contact member 11 is received in the contact receptacle 16 and is welded thereto.

However, the spring contact element 11 may also be held directly in the insulation body 2, i.e. without the contact receptacle 16.

The free end 12 of the spring contact member 11 as shown in the top area is provided for contacting and clamping an electrical conductor or pin contact 8 to be inserted.

In the course of this, the free end 12, which is preferably made up of two legs, is clamped in the contact chamber 2. An electrical conductor or pin contact 8 may be inserted between the contact leg 15 and a lateral surface 5 of the contact chamber 2 and may be mechanically fixed and electrically contacted via the spring force of the spring contact member 11.

The second leg—the spring force leg 14—is used to receive the spring force transmitted by the contact leg 15. To this end, the spring force leg 14 rests against the lateral surface 4 that is opposite the lateral surface 5.

In this embodiment, the spring contact member 11—as has already been described above—is not received directly in the contact chamber 2 but is surrounded, at least in sections, by the contact receptacle 16.

The contact receptacle 16 forms a contact region 17 that rests against the lateral surface 5 of the contact chamber 3, on which an electrical conductor or pin contact 8 to be connected is contacted. As a result, the conductor or pin contact 8 is advantageously electrically contacted from two sides—from the contact area 17 and from the spring contact member 11.

As shown in the bottom area of FIG. 2, the contact receptacle 16 moreover has a connection region 18. This is provided for the onward transmission of electrical signals transmitted via the contacting unit 1. The connection region 18 can here be reversibly connected as a screw connection, as a solder connection or with other contacting means known to a person skilled in the art.

In an embodiment of the contacting unit 1 according to the invention without a contact receptacle 16 it is conceivable to provide a connection region 18 directly on the spring contact member 11.

According to the invention, a sliding element 20 is provided between the spring force leg 14 and the lateral surface 4 on the side of the contact chamber 3 that faces away from the contact leg 15. The sliding element 20 can be displaced along the spring force leg 14.

In this embodiment, in order to actuate the sliding element 20, an actuator 21 is moulded onto the side of the sliding element 20 that faces away from the spring force leg 14. Access to the actuator 21 is possible from outside the insulation body 2. Thus, for example, the actuator 21 and thus the sliding element 20 can be displaced by means of a screwdriver or a similar item.

In the position of the sliding element 20 as shown in FIG. 2, a great spring force of the contacting unit 1 is adjusted. Since the sliding element 20 is located on the end of the spring force leg 14 that faces the contact leg 15, only the contact leg 15 can be elastically deformed. This small spring-loaded area of the spring contact member 11 causes a high spring force and thus contacting force of the contacting unit 1.

Figure 3:
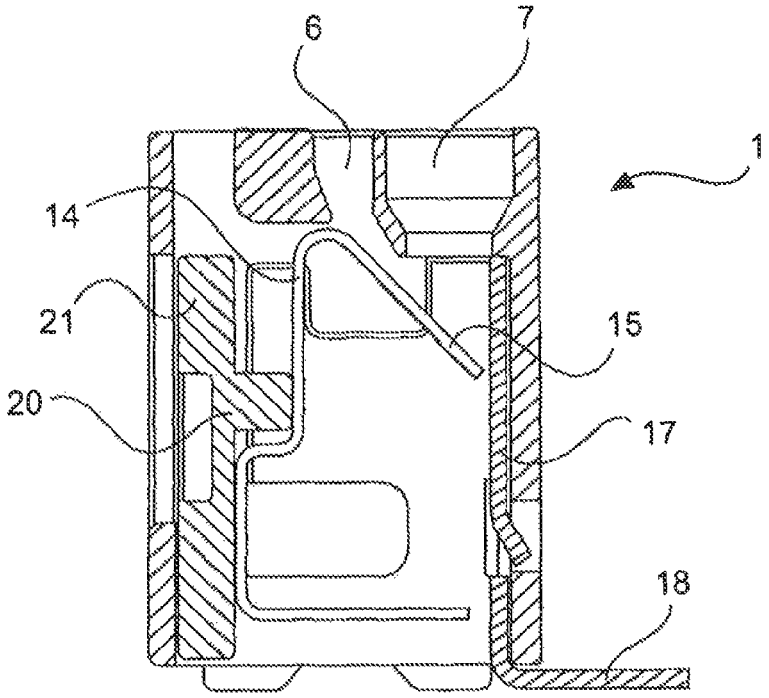
FIG. 3 shows a further cross section through a contacting unit.

Compared to the position shown in FIG. 2, the sliding element 20 in the contacting unit 1 shown in FIG. 3 is located on the end of the spring force leg 14 that faces away from the contact leg 15. As a result, the spring-loaded region of the spring contact member 11 is longer than that in FIG. 2. As a result of the longer spring-loaded region of the spring contact member 11, a spring force that is lower than the one in FIG. 2 is achieved.

When inserting an electrical conductor or pin contact 8 into the contacting unit 11, not just the contact leg 15, but both the contact leg 15 and the spring force leg 14 are elastically deformed.

Figure 4:
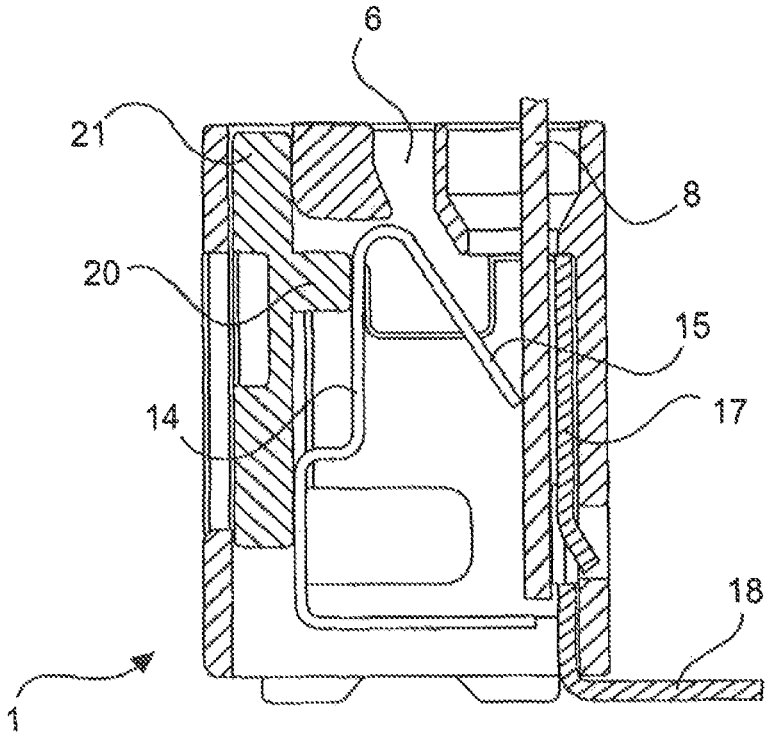
FIG. 4 shows a cross section through a contacting unit with a contacted electrical conductor.
Figure 5:
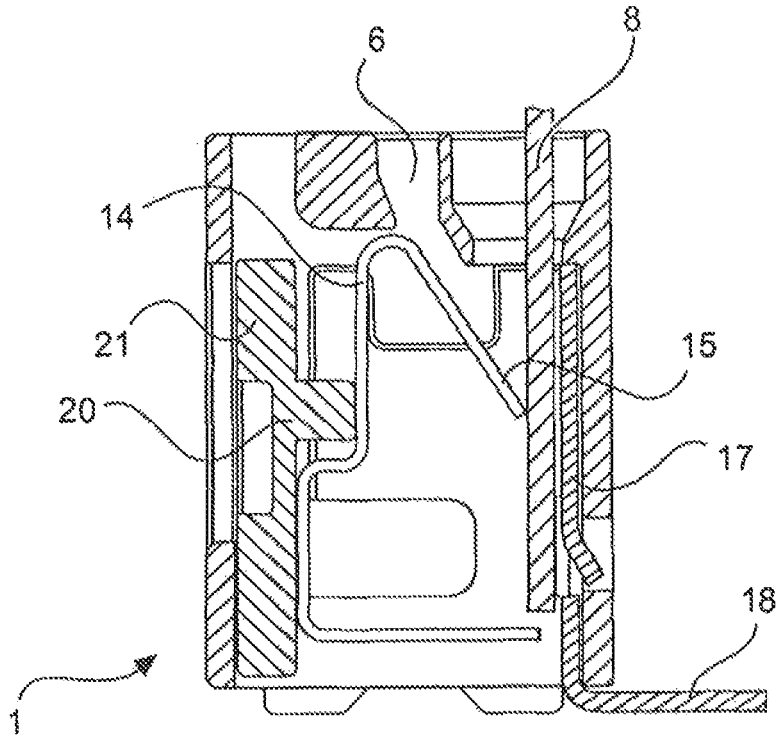
FIG. 5 shows a further cross section through a contacting unit with a contacted electrical conductor.

In FIG. 4 and in FIG. 5, the contacting units 1 of FIG. 2 and FIG. 3 are shown again, however with a respectively inserted and contacted electrical conductor 8.

The electrical conductor 8 is in each case clamped between the contact leg 15 of the spring contact member 11 and the contact region 17 of the contact receptacle 16. As a result of the clamping, an electrical contact and mechanical fixing of the electrical conductor 8 are ensured.

It can be seen in FIG. 4 that as a result of the position of the sliding element 20, the spring contact member 11 does not elastically deform until from the contact leg 15 onwards. This small deforming region of the spring contact member 11 generates a high contacting force that acts on the electrical conductor 8.

In FIG. 5, apart from the contact leg 15, also the spring force leg 14 deforms as a result of the position of the sliding element 20. As a result of the longer spring-loaded region of the spring contact member 11, the generated contacting force acting on the electrical conductor 8 is lower than the one shown in FIG. 4.

Positions of the sliding element 20 between the maximum positions shown in FIGS. 4 and 5 are also conceivable. Thus, an even finer adjustment of the spring force becomes possible for example by latching the sliding element 20.

Figure 6:
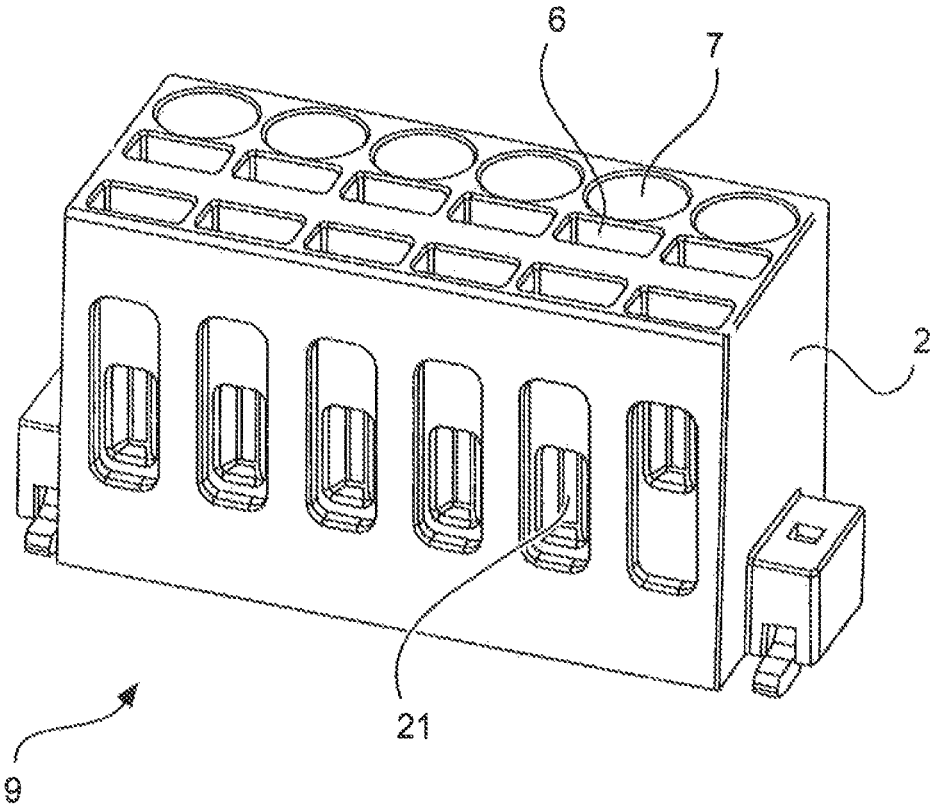
FIG. 6 shows a terminal block with contacting units according to the invention.

FIG. 6 shows a plug-in connector 9 to be soldered onto a printed circuit board with contacting units 1 corresponding to FIGS. 1 to 5 provided therein. In this embodiment example, the insulation body 2 has six contacting units 1. On the top surface, an insertion opening 7 is provided for each of the contacting units 1, into which an electrical conductor or pin contact 8 to be connected can be inserted into the contacting unit 1.

Apart from the insertion openings 7, a release opening 6 is also provided in each case. Into this opening, a screwdriver or a similar elongated item can be inserted in order to release the contact.

On the side of the insulation body 2, actuators 21 for adjusting the contacting force can be seen. The five actuators on the left are adjusted to a low contacting force, the one on the right to a high contacting force (cf. FIG. 4 and FIG. 5).

The invention relates to a contacting unit for electrical conductors and in contacts, consisting of a spring contact member disposed in a contact chamber, wherein the spring contact member has a free and a fixed end, which free end is formed from at least two legs, with a first spring force leg resting against a lateral surface of the contact chamber, a second contact leg protruding into the contact chamber on a lateral surface that is opposite the lateral surface and forms a free, spring-loaded length of the free end, and in that the contact leg is used for contacting an electrical conductor or pin contact to be inserted between the contact leg and the lateral surface, characterised in that between the spring force and the lateral surface, a sliding element is provided, against which the spring force leg rests, wherein the sliding element can be displaced along the spring force leg, so that the free, spring-loaded length of the free end of the spring contact member can be varied and can be extended from the contact leg to the spring force leg.

LIST OF REFERENCE NUMERALS

1. Contacting unit
2. Insulation body
3. Contact chamber
4. Lateral surface
5. Lateral surface
6. Release opening
7. insertion opening
8. Electr. conductor/contact
9. Plug-in connector
11. Spring contact member
12. Free end
13. Fixed end
14. Spring force leg
15. Contact leg
16. Contact receptacle
17. Contact region
18. Connection region
20. Sliding element
21. Actuator

The invention claimed is:

1. A contacting unit for electrical conductors and pin contacts, consisting of a spring contact member (11) provided in a contact chamber (2), wherein the spring contact member (11) has a free end (12) and a fixed end (13), wherein the free end (12) is formed from at least two legs, wherein a first spring force leg (14) rests against a lateral surface (4) of the contact chamber (3), wherein a second contact leg (15) protrudes into the contact chamber (3) on a lateral surface (5) that is opposite the lateral surface (4), and forms a free, spring-loaded length of the free end (12), wherein the contact leg (15) is used for contacting an electrical conductor or pin contact to be inserted between the contact leg (15) and the lateral surface (5), wherein a sliding element (20) is provided between the spring force leg (14) and the lateral surface (4), against which sliding element and the spring force leg (14) rests, and wherein the sliding element (20) can be displaced along the spring force leg (14), characterised in that the sliding element (20) can be moved into two maximum positions as well as into positions there between, so that the free, spring-loaded length of the free end (12) of the spring contact member (11) can be finely varied and can be extended from the contact leg (15) to the spring force leg (14), and in that the contact leg (15) contacts an inserted electrical conductor or pin contact in any position of the sliding element (20).

2. The contacting unit as claimed in claim 1, characterised in that the sliding element (20) includes an actuator (21) that can be actuated from outside of the contact chamber (3).

3. The contacting unit as claimed in claim 1, characterised in that the sliding elements (20) of a plurality of contacting units (1) arranged next to each other are provided with a group actuator, by means of which all the sliding elements (20) can be actuated at the same time and which can be actuated from outside of the contact chamber (3).

4. The contacting unit as claimed in claim 1, characterised in that the contacting unit (1) has a contact receptacle (16), wherein the contact receptacle (16) receives the spring contact member (11), is mechanically connected thereto and is disposed together therewith in the contact chamber (3).

5. The contacting unit as claimed in claim 4, characterised in that the contact receptacle (16) has a contact region (17), wherein the latter is provided between the contact leg (15) and the lateral surface (5) of the contact chamber (3).

6. contacting unit as claimed in claim 1, characterised in that at least one contacting unit (1) is provided in an insulation body (2), which is formed as a plug-in connector or a terminal block.

7. The contacting unit as claimed in claim 1, characterised in that the sliding element (20) has at least two, preferably more than two detents so as to be latched between the two maximum positions.

8. A plug-in connector for releasably contacting a mating plug-in connector, characterised in that the plug-in connector, for contacting an electrical conductor to be connected, has at least one contacting unit (1) as claimed in claim 1.

* * * * *